US005378071A

United States Patent [19]

Uehara

[11] Patent Number: 5,378,071

[45] Date of Patent: Jan. 3, 1995

[54] VIDEO PRINTER

[75] Inventor: Masahiro Uehara, Kanagawa, Japan

[73] Assignee: Sony Coporation, Japan

[21] Appl. No.: 77,938

[22] Filed: Jun. 18, 1993

[30] Foreign Application Priority Data

Jun. 25, 1992 [JP] Japan ..... 4-190137

[51] Int. Cl.[6] ..... B41J 13/03

[52] U.S. Cl. ..... 400/636.1; 400/624; 400/120.16

[58] Field of Search ..... 400/120 R, 120 MP, 120 HE, 400/629, 636.1, 626.3, 624, 625; 346/76 PH, 134

[56] References Cited

U.S. PATENT DOCUMENTS 4,958,950 9/1990 Kobayashi et al. ..... 400/624
5,062,722 11/1991 Shiozaki ..... 400/120
5,165,806 11/1992 Collins ..... 400/120 HE

FOREIGN PATENT DOCUMENTS 58-102789 6/1983 Japan ..... 400/636.1
72767 4/1985 Japan ..... 400/636.1
1-272474 10/1989 Japan ..... 400/629
67675 3/1991 Japan ..... 400/636.1

OTHER PUBLICATIONS

"Two-Step Pressure-Controlled Paper-Feed Mechanism", *IBM TDB;* vol. 33; No. 1A, pp. 483–484, Jun. 1990.

*Primary Examiner*—David A. Wiecking
*Attorney, Agent, or Firm*—Ronald P. Kananen

[57] ABSTRACT

A video printer is disclosed in which a duplicated driving force is not applied to a sheet of paper 2 in a printing mode. Pressing rollers 101 are pressed against and separated away from paper-ejecting rollers 100 by a pressing mechanism 18 of a paper-ejecting device. The pressing rollers 101 are separated away from the paper-ejecting rollers 100 at least in a printing mode and the pressing rollers 101 are pressed against the paper-ejecting roller 100 at least in a paper-ejecting mode, thereby ejecting the sheet of paper 2, which has been printed, from an outer circumference of a platen 80.

14 Claims, 16 Drawing Sheets

VIDEO PRINTER

BACKGROUND OF THE INVENTION

1. Field of the Invention

The present invention relates to a video printer which performs thermal transfer type printing of color images and the like using photographic printing paper cut into sheets.

2. Description of the Related Art

There are conventional video printers having a configuration wherein a sheet of paper cut from photographic printing paper to a size such as A3 is fed from a paper feeding tray to a platen and is pressed onto and wound around the outer circumference of the platen by a plurality of pinch rollers; an ink ribbon stretched between a pair of reels is pressed against the sheet of paper on the outer circumference of the platen by a thermal head; the rotary drive of the platen transports the sheet of paper and the ink ribbon together with the sheet of paper simultaneously; and the transportation of the sheet of paper and the ink ribbon is repeated several times to sequentially overprint yellow, cyan and magenta (three primary colors) sublimating color materials (dyes), with which the ink ribbon is coated, onto the sheet of paper by thermal transfer, thereby printing a color image on the sheet of paper.

This type of video printer is configured so that the sheet of paper which has been printed is pressed against a motor driven paper-ejecting roller by a pressing roller and then ejected onto an ejected paper table beside the platen.

In a conventional video printer, the pressing roller is always pressed against the paper-ejecting roller in all the modes thereof, i.e., the paper-feeding mode wherein the sheet of paper is fed from the paper-feeding tray to the platen, the printing mode wherein the operation of transporting the sheet of paper together with the ink ribbon by means of the rotation of the platen is repeated several times with the ink ribbon pressed against the sheet of paper on the outer circumference of the platen by the thermal head, and the paper-ejecting mode wherein the sheet of paper which has been printed is ejected from the outer circumference of the platen onto the ejected paper table beside the platen.

Therefore, in the conventional art, especially in the printing mode, the sheet of paper is pressed onto the outer circumference of the platen by the pinch rollers and is also pressed against the paper-ejecting roller by the pressing roller at the same time. As a result, both the platen and the paper-ejecting roller apply a driving force to the sheet of paper. Variations in the two driving forces can easily cause slippage and the like of the sheet of paper relative to the platen, resulting in damage to the printed surface immediately after printing, offset of the printed images, and the like.

In cases where the leading edge of the sheet of paper is brought between the paper-ejecting roller and the pressing roller immediately after printing, there is the problem that the impact causes unevenness in printing.

The present invention has been conceived to solve the above-described problem, and it is an object of the present invention to provide a video printer wherein two driving forces are not applied to the sheet of paper in the printing mode.

SUMMARY OF THE INVENTION

A video printer of the present invention for achieving the above object is a video printer for printing an image using a sheet of photographic printing paper comprising a printing device having a thermal head, a platen, and an ink ribbon, a paper-feeding device for intermittently feeding the sheets of paper stacked in a paper-feeding tray to the printing device, a paper-ejecting device for ejecting the sheets of paper out of the printing device by pressing the sheets of paper against at least one paper-ejecting roller, and a pressing mechanism for pressing at least one pressing roller against the paper-ejecting roller, and separating it from the paper-ejecting roller at least in a printing mode and for pressing the pressing roller to the paper-ejecting roller so that the pressing roller is press to the paper-ejecting roller at least in a paper-ejecting mode.

In this case, the pressing mechanism is preferably separated away from and pressed against the paper-ejecting roller in synchronism with the operations of pressing the thermal head against and the platen and separating the thermal head away from the platen.

Preferably, the pressing mechanism has a support lever for pressing and separating the pressing roller against the paper-ejecting roller and separating it from the paper-ejecting roller and a pressing lever for driving the support lever for a rotary motion through a pressing spring; it is configured to press the pressing roller to the paper-ejecting roller by means of the spring force of the pressing spring; the support lever and the pressing lever of the pressing mechanism are rotatably supported by a common pivot lever shaft; and the pressing spring is constituted by a plate spring.

In the video printer of the present invention having the configuration as described above, the pressing roller is configured so that it can be pressed against and separated to and from the paper-ejecting roller by the pressing mechanism of the paper-ejecting device; the pressing roller is separated from the paper-ejecting roller at least in the printing mode; and the pressing roller is pressed to the paper-ejecting roller at least in the paper-ejecting mode.

As a result, a sheet of paper is transported only by the driving force of the platen in the printing mode and there is no possibility that the driving force applied to the sheet of paper is duplicated in the printing mode.

The pressing mechanism can be easily driven by a thermal head driving mechanism by separating the pressing roller away from and press-fitting it against paper-ejecting roller in synchronism with the operations of pressing the thermal head against and separating it away from the platen.

Further, the pressing mechanism can be made simple and compact by driving the support lever for pressing the pressing roller against and separating it away from the paper-ejecting roller for a rotary motion by the pressing ever through the pressing spring, and by rotatably supporting the support lever .and the pressing lever by the common pivot lever shaft, the press-fit spring being constituted by a leaf spring.

BRIEF DESCRIPTION OF THE DRAWINGS

In the accompanying drawings:

FIG. 14 shows a printing mode. In the printing device 8, an ink ribbon 84 is wound between a winding reel 85 and a supply reel 86 disposed above and below the platen 80, respectively, to extend in an up-and-down direction between the platen 80 and the thermal head 83. Sublimating color materials (i.e., dyes or the like) of yellow, cyan and magenta (three primary colors) are coated on a surface of the ink ribbon on the platen 80 side in a repeated pattern at a constant pitch.

Figure 14:
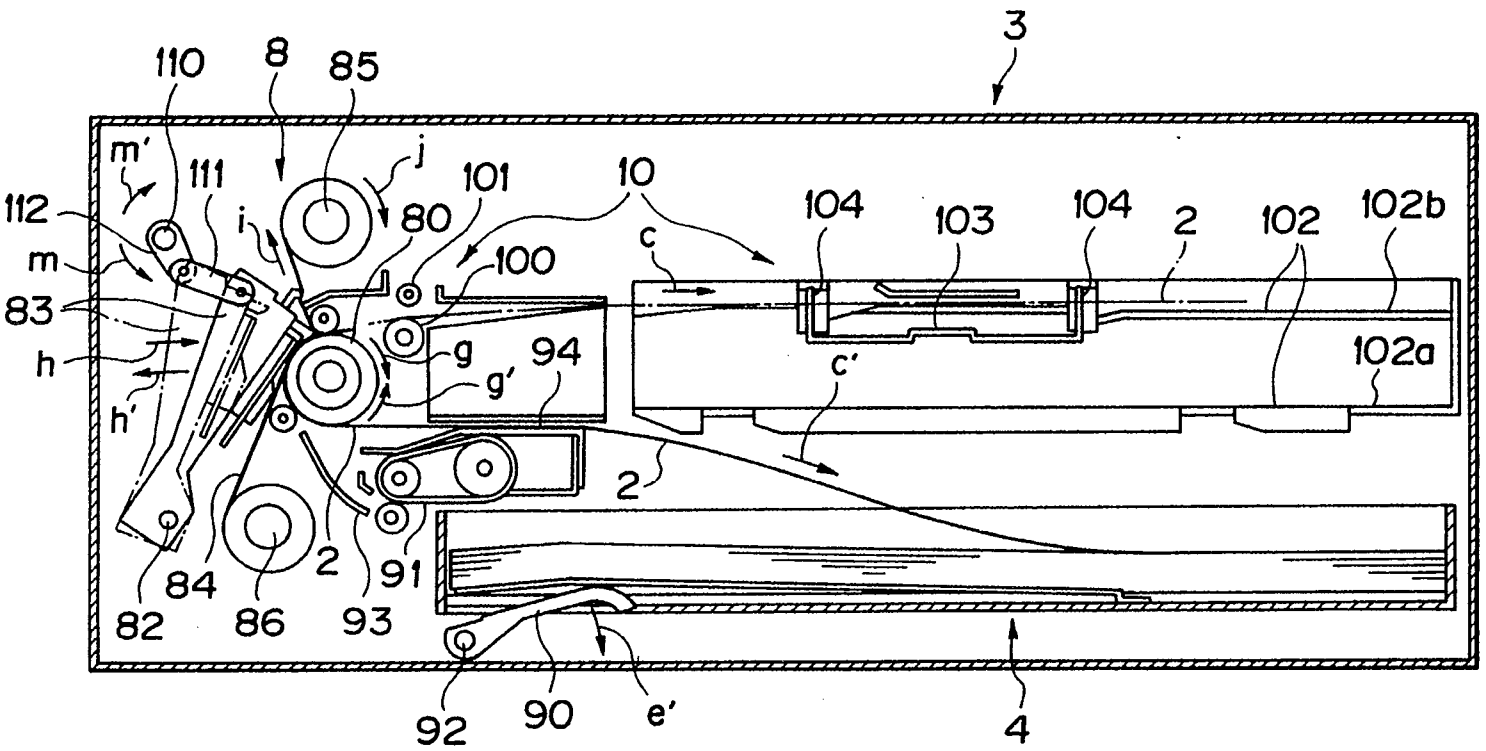
FIG. 14 is a cross-sectional, front view showing a printing mode of the video printer.

As shown by the solid line in FIG. 14, the thermal head 83 is rotated about the pivot lever shaft 82 in the direction of the arrow h. The thermal head 83 causes the ink ribbon 84 to pressingly contact against the cut sheet 2 on the outer circumference of the platen 80 in the direction h of the arrow h. At the same time, the platen 80 is drivingly rotated in the direction of the arrow g. Then, the cut sheet 2 is fed at a low speed in the direction of the arrow c, and at the same time, the ink ribbon 84 is fed in the direction of the arrow i together with the sheet 2 by the frictional torque between the paper 2 and the ink ribbon 84, thereby performing a first printing process. Incidentally, in this case, the ink ribbon 84 which has been fed in the direction of the arrow i is to be wound onto the winding reel 85 in the direction of the arrow j. In the first printing process, the yellow dyes of the ink ribbon 84 is sublimated by heats of the thermal head 83, and are transferred to form yellow images on the sheet of paper 2.

Subsequently, as shown by the one-dot and dash line in FIG. 14, the thermal head 83 is separated away from the platen 80 in the direction of the arrow h, and the platen 80 is driven for reverse rotation in the direction of the arrow g' to thereby return the sheet of paper 2 in the direction of the arrow c' onto the paper feeding table 94. Thereafter, a second printing process is carried out in the same manner. The magenta dyes on the ink ribbon 84 are sublimated and thermally transferred to the sheet 2 to print the magenta images over the yellow images thereon.

In the same manner, a third printing process is carried out. The cyan dyes on the ink ribbon 84 are sublimated and thermally transferred to the sheet of paper 2 so that the cyan images are printed over the yellow and magenta images on the sheet 2. Thus, finally, color images synthesized with the yellow, magenta and cyan dyes may be obtained.

Figure 15:
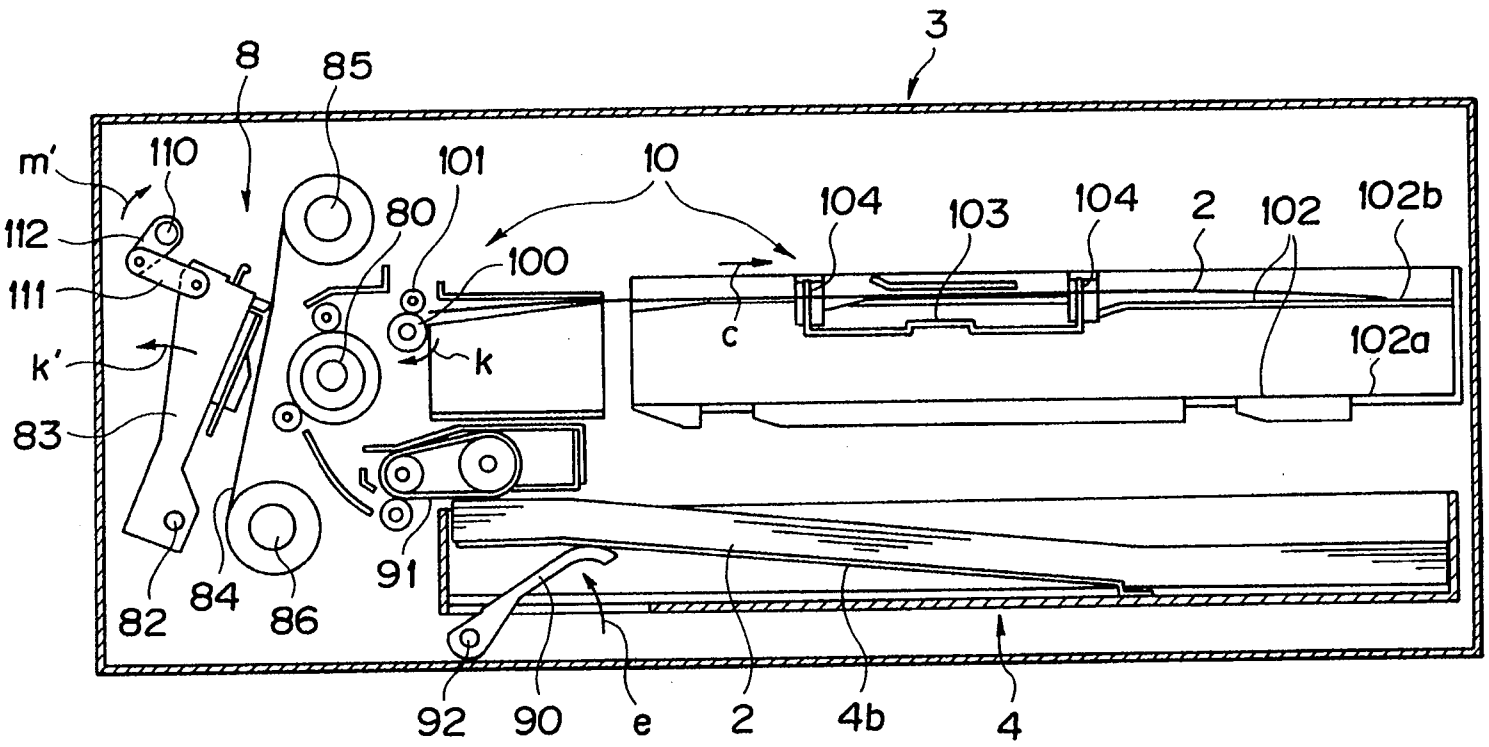
FIG. 15 is a cross-sectional, front view showing a paper-ejecting mode of the video printer.

FIG. 15 shows a paper-ejecting mode. After the printing process, paper ejecting rollers 100 of a paper-ejecting device 10 are drivingly rotated in the direction of the arrow k. The sheet of paper 2 pressed against the paper-ejecting rollers 100 by pressing rollers 101 is ejected in the direction of the arrow c from the outer circumference of the platen 80. Then, the sheet 2 is placed on a paper-ejecting table 102 disposed beside the paper-ejecting rollers 100. Thereafter, the sheet of paper 2 is ejected in the direction of the arrow d (in FIG. 16) by a paper-ejecting slider 103 of the paper-ejecting device 10 and is fed out to the paper-ejecting port 6.

DESCRIPTION OF THE PREFERRED EMBODIMENTS

An embodiment of a video printer of the present invention will now be described with reference to the accompanying drawings.

General Description of the Video Printer

Figure 16:
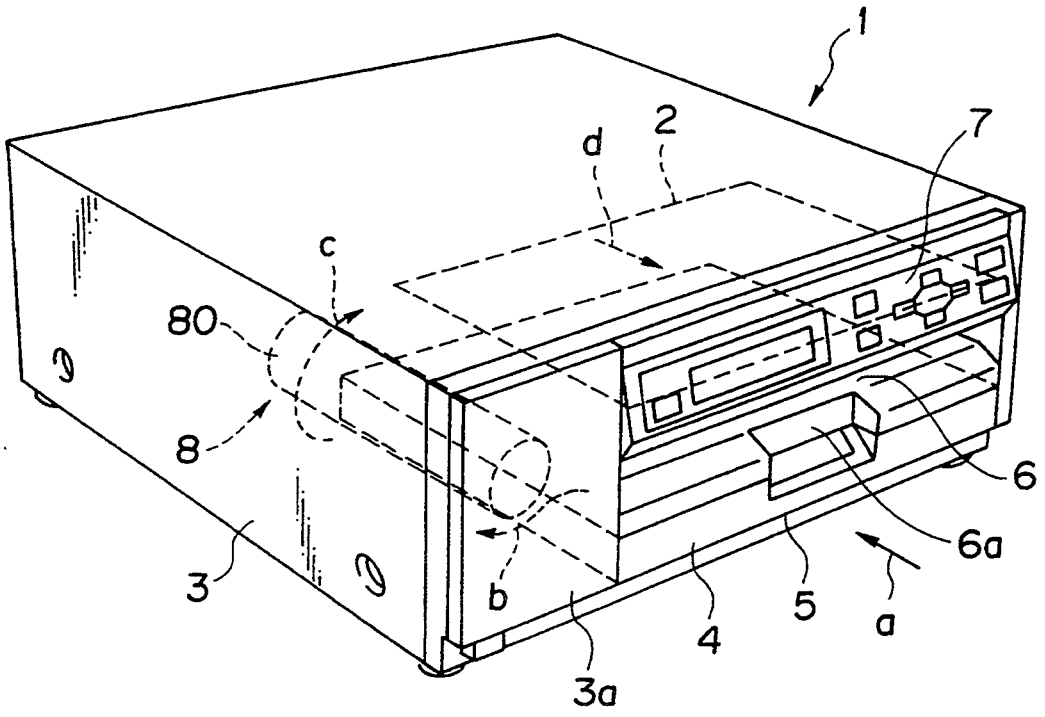
FIG. 16 is a perspective view of the entire video printer.

The video printer will now be generally described with reference to FIG. 16.

The video printer 1 prints a color image on a sheet of paper 2 cut from photographic printing paper into a size such as A3. An insertion port 5 of a paper-feeding tray 4, a paper-ejecting port 66 for ejecting the sheet of paper 2, an operation panel 7 and the like are provided in this order in a position close to one side (a position on the right-hand side of FIG. 16) of a front panel 3*a* of a main printer body 3. A printing device 8 is housed at one side portion (the left-hand side of FIG. 16) inside the main printer body 3 where the paper-feeding tray 4 is mounted, and a platen 80 of the printing device 8 is disposed in parallel with the direction indicated by the arrow d in which the sheets of paper are ejected by an eject paper slider of the paper-ejecting device to be described later.

The multiplicity of sheets of paper 2 are stored in the paper-feeding tray 4 one over the other, and the paper-feeding tray 4 is mounted in the main printer body 3 by horizontally inserting it from the insertion port 5 of the front panel 3*a* in the direction indicated by the arrow a.

When printing is started, a paper-feeding device to be described later feeds the uppermost sheet of paper 2 in the paper-feeding tray 4 to the platen 80 of the printing device 8 from the underside thereof in the direction indicated by the arrow b perpendicular to the direction indicated by the arrow a which is the mounting direction of the paper-feeding tray 4.

When printing is finished, the paper-ejecting roller of a paper-ejecting device to be described later ejects the sheet of paper 2 from the upper side of the platen 80 of the printing device 8 to a position above the paper-feeding tray 4 in the direction indicated by the arrow c which is opposite to the direction indicated by the arrow b.

Thereafter, the sheet of paper 2 is ejected by the eject paper slider of the paper-ejecting device in the direction indicated by the arrow d which is perpendicular to the direction indicated by the arrow c in which the sheet of paper 2 is transported during printing and which is opposite to the mounting direction of the paper-feeding tray 4 and is horizontally sent out to the paper-ejecting port 6.

Description of the Modes of the Video Printer

Figure 12:
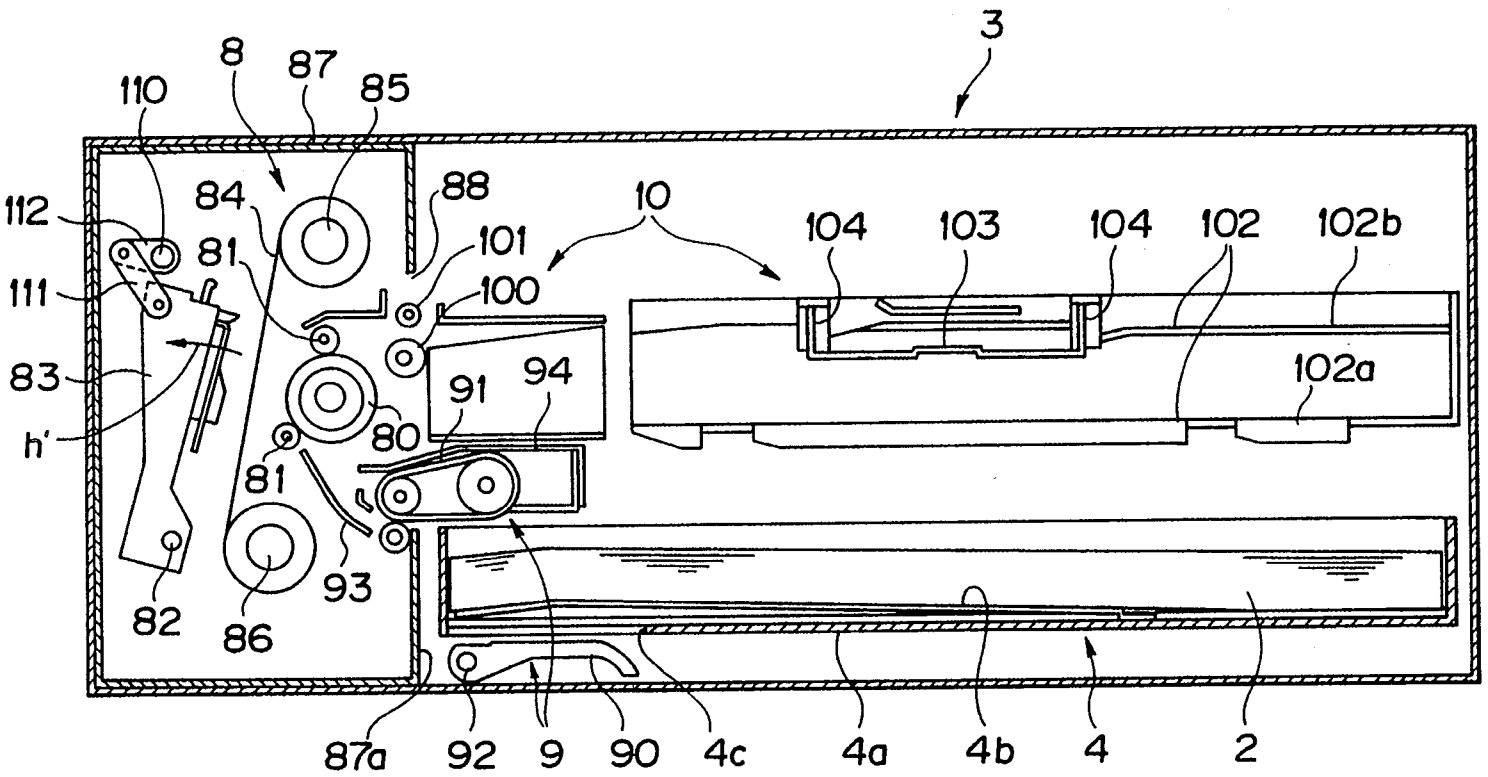
FIG. 12 is a cross-sectional, front view showing an initial stage of the video printer.

FIG. 12 shows the initial state wherein the paper-feeding tray 4 has been mounted. A paper receiving plate **4*b* is placed on the bottom portion 4*a* of the paper feeding tray 4, and a multiplicity of sheets of paper 2 are piled on the top of the paper receiving plate 4*b* and are received in the paper feeding tray 4. The paper feeding tray 4 is horizontally inserted between a paper feeding lever 90 and a paper feeding belt 91 constituting a paper feeding device 9 disposed on the bottom of the main printer body 3, and an opening 4*c* formed at the bottom portion 4*a* of the paper feeding tray 4 is set to a position directly above the paper feeding lever 90**.

Figure 13:
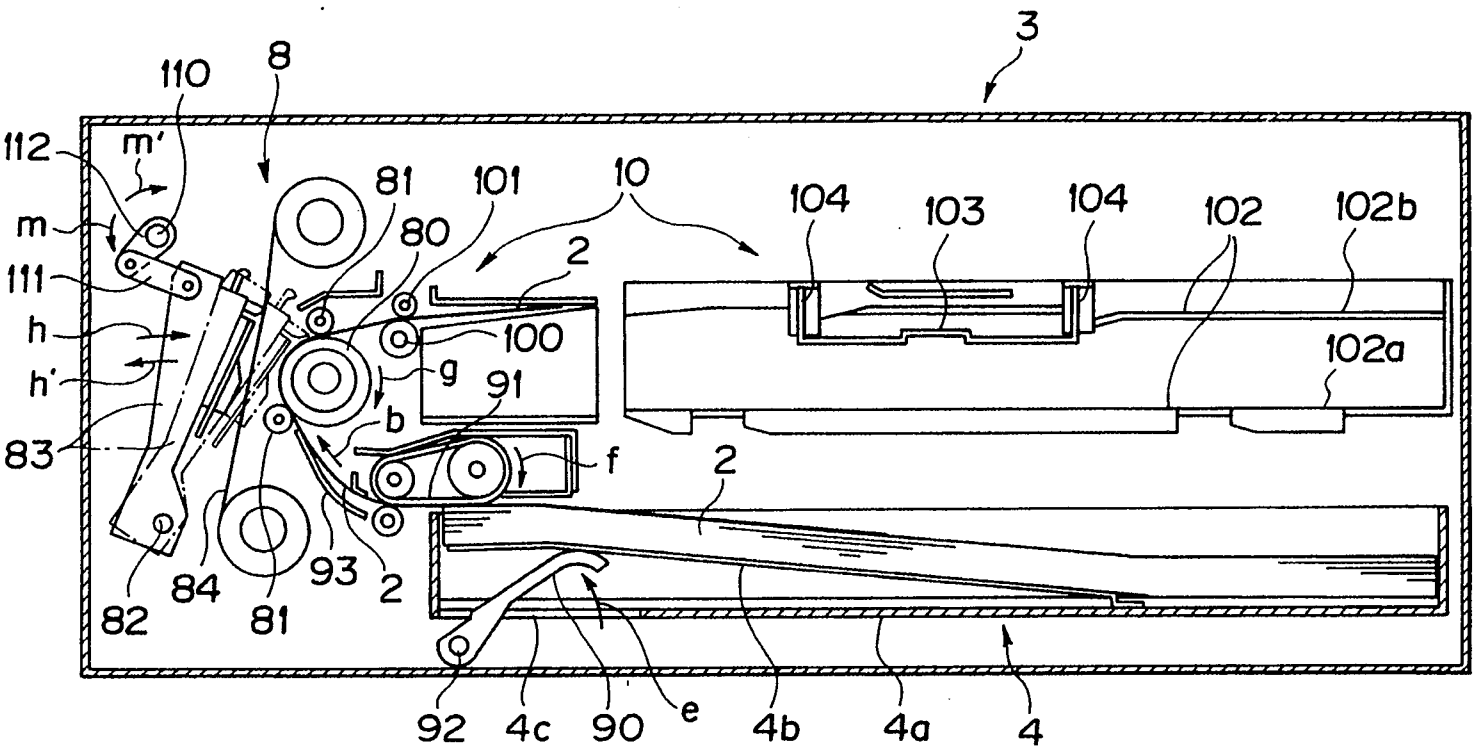
FIG. 13 is a cross-sectional, front view showing a paper feeding mode of the video printer.

Next, FIG. 13 shows a paper feeding mode wherein the paper feeding lever 90 of the paper feeding device 9 is driven to rotate in the direction indicated by the arrow e which is an upward direction to a paper feeding position; the paper feeding lever 90 is inserted into the paper feeding tray 4 from the underside thereof through the opening **4*c* to push the paper receiving plate 4*b* upward, thereby urging the uppermost sheet of paper 2 on the bottom thereof against the paper feeding belt 91**.

Then, the paper feeding belt 91 and the platen 80 of the printing device 8 are driven to rotate in the directions indicated by the arrows f and g, respectively, to send out the uppermost sheet of paper 2 in the direction of the arrow b. The sheet of paper 2 is guided by a paper feeding guide 93 and is wound around the outer circumference of the platen 80 from the underside thereof.

At this time, the sheet of paper 2 is guided by a pair of pinch rollers 81 which are pressed to the outer circumference of the platen 80 driven to rotate in the direction of the arrow g to be rotated in synchronism with the platen 80 and a thermal head 83 which is rotated in the direction of the arrow h about a pivot lever shaft 82 as indicated by the dashed line temporarily only immediately after the start of paper feeding and which is returned in the direction of the arrow h' to a separated state. The sheet of paper 2 is thus wound around the outer circumference of the platen 80 at a high speed in the direction of the arrow c.

After the sheet of paper 2 is once sent out in the direction of the arrow c to the position indicated by the one-dot and dash line in FIG. 14, the paper feeding lever 90 is returned in the direction of the arrow e' to a printing position as shown in FIG. 14 and, at time same time, the platen 80 is driven for a reverse rotation in the direction of the arrow g' to return the sheet of paper 2 to a position indicated by the solid line in FIG. 14 in the direction of the arrow c' at a high speed, thereby setting the sheet to a printing start position on a paper feeding table 94 disposed on both sides of the paper feeding belt 91. Incidentally, during this operation, the thermal head 83 is separated away from the platen in the direction of the arrow h' as indicated by the one-dot and dash line in FIG. 14.

General Description of the Paper-ejecting Device

The paper-ejecting device will now be described with reference to FIGS. 11 to 15.

The paper-ejecting device 10 is composed essentially of the paper-eject rollers 100 such as rubber rollers or the like disposed in parallel with the platen 80 at a obliquely upward position of the platen 80 on the right-hand side, the pressing rollers 101 such as rubber rollers or the like which rollers 101 can be separated away from and pressed against the paper-ejecting rollers 100, the paper-ejecting table 102 located on the right side of these rollers at a position just above a paper feeding tray 4, and the paper-ejecting slider 103 which is linearly horizontally moved in the directions of arrows d and d'. The paper-ejecting table 102 is formed in a stepwise configuration by a horizontal low level portion **102*a* contiguous with the paper-ejecting port 6 and a high level portion 102*b* which is at almost the same level as the paper-ejecting rollers 100. Also, the paper-ejecting slider 103 is disposed in the lower portion of the high level portion 102*b*. A pair of upright paper-ejecting pieces 104 are formed for pressing the trailing edge 2*a* of the sheet of paper 2 at two positions P1 and P2 equidistant from a center P of the transverse direction of the sheet of paper 2. The pair of paper-ejecting pieces 104 are projected in the vertical direction upwardly of the high level portion 102*b* through a pair of slits 105 which are formed in the high level portion 102*b*** in parallel with the directions d and d'.

In the paper-ejecting mode, as best shown in FIG. 15, the sheet of paper 2 is pressed against the paper-ejecting rollers 100 by the pressing rollers 101, and the driving rotation of the paper-ejecting rollers 100 in the direction of the arrow k causes the sheet of paper 2 to be ejected at a high speed in the direction of the arrow c from the outer circumference of the platen 80. Then, as indicated by the solid line in FIG. 11, the sheet of paper 2 is placed to embrace the top surfaces of the high and low level portions **102*a* and 102*b***.

Figure 11:
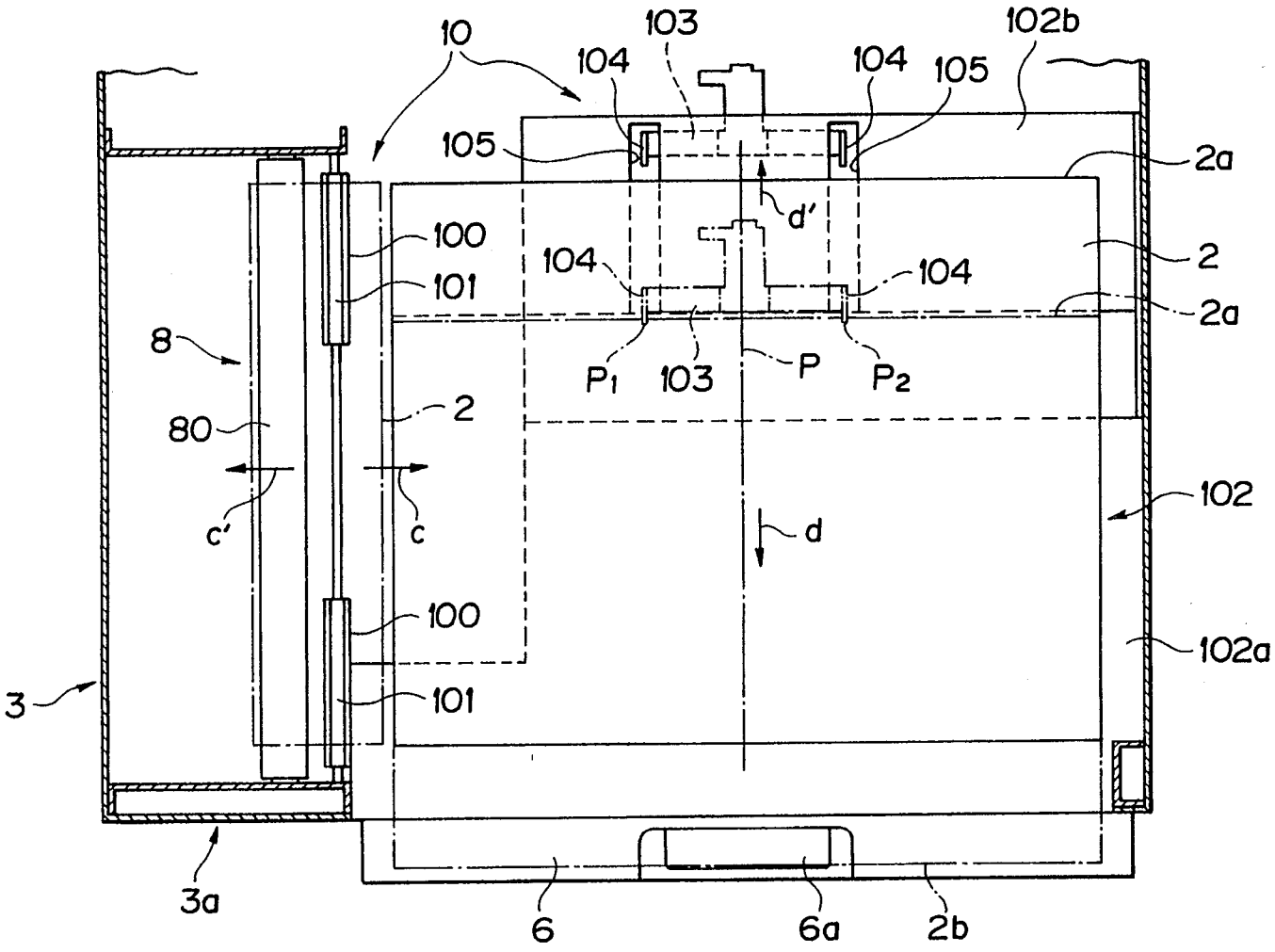
FIG. 11 is a partially fragmentary plan view showing an overall paper feeding device.

Subsequently, the paper-ejecting slider 103 is linearly moved from a return position indicated by the solid line in FIG. 11 to an advance position indicated by the one-dot and dash line in FIG. 11 in the direction of the arrow d. As a result, the pair of paper-ejecting pieces 104 push the two points P1 and P2 of the trailing edge **2*a* of the sheet of paper 2 in the direction of the arrow d. As shown by the one-dot and dash line in FIG. 11, the sheet of paper 2 is slid down from the high level portion 102*b* to the low level portion 102*a* of the paper-ejecting table 102 in the direction of the arrow d with the leading edge 2*b* of the sheet 2 being fed out to the paper-ejecting port 6 below an operation panel 7 of the main printer body 3**.

Thus, the sequential paper-ejecting operation is completed. The operator inserts his fingers in a recess **6*a* formed in the central lower portion of the paper-ejecting port 6 and may pick up the sheet of paper 2 in the direction of the arrow d outside the paper-ejecting port 6**.

By the way, in the paper-ejecting device 10, under the initial state shown in FIG. 12, the pressing rollers 101 are separated upwardly from the paper-ejecting rollers 100. In the paper feeding mode shown in FIG. 13, the pressing rollers 101 are pressed against the paper-ejecting rollers 100, and the sheet of paper 2 is transported at a high speed in the directions of the arrows c and c' by the duplicated driving force of the platen 80 and the paper-ejecting rollers 100. Then, in the printing mode shown in FIG. 14, the pressing rollers 101 are separated upwardly away from the paper-ejecting rollers 100. The sheet of paper 2 is stably transported at a low speed in the directions of the arrows c and c' mainly by the driving force of the platen 80.

Explanation of Printing Device Block

A printing device block 87 will be explained with reference to FIG. 12.

The printing device block 87 is substantially box-shaped and encases therein the printing device 8 which is essentially composed of the platen 80, the pinch rollers 81, the pivot lever shaft 82, the thermal head 83, the winding reel 85, the supply reel 86, and the paper-ejecting rollers 100 and the pressing rollers of the paper-ejecting rollers 101 of the paper-ejecting device 10. An opening 88 is formed in a side wall 87*a* of the printing deice block 87 on the paper feeding tray 4 side. The paper feeding lever 90 is provided at the lower edge of the side wall 87*a* by a bracket 95 which also serves as a paper feeding tray insertion table. The paper feeding belt 91, the paper feeding table 94 and the like are also mounted on the side wall 87*a*. The horizontal pivot lever shaft 82 of the thermal head 83 is provided at its opposite ends to front and rear walls of the printing device block 87. A thermal head drive shaft 110 on an upper and rear side of the thermal head 83 is horizontally provided at its opposite ends to the front and rear walls of the printing device block 87. A pair of links 111 rotatably supported on both upper sides of the thermal head 83 are connected to a pair of drive arms 112 fixed to both ends of the thermal headshaft 110.

Explanation of Paper Feeding Lever Mounting Structure

A mounting structure for the paper feeding lever 90 of the paper feeding device 9 will be described with reference to FIGS. 6 and 7.

The bracket 95 which serves as the paper feeding tray insertion table has a substantially L shape in cross section and is fastened horizontally to the side wall 87*a* of the printing device block 87 by fastening means such as rivets. The rotary shaft 92 extends horizontally through a plurality of bent pieces 95*a* bent vertically downwardly from the bracket 95. The paper feeding lever 90 fixed to a front end portion of the rotary shaft 92 is mounted rotatably in the directions of the arrows e and e' in a cutaway portion 96 formed in the bracket 95.

Explanation of Thermal Head and Paper Feeding Lever Drive Mechanism

A thermal head/paper feeding lever drive mechanism (which will hereinafter be simply referred to as a "drive mechanism") will now be described with reference to FIGS. 6 through 10.

The drive mechanism 11 is mounted between the rear wall 87*b* of the printing device block 87 and a bracket 113 fastened to the rear wall 87*b* by means of fastening means such as rivets. A thermal head drive transmission system 114 is composed of a single motor 115 mounted on the bracket 113, a worm 116 fixed to a shaft of the motor 115, a worm wheel 117 mounted on the rear wall 87*b* and meshed with the worm 116, an intermediate gear 118 formed into one piece with the worm wheel 117 and a cam gear 119 fixed to the rear end of the thermal head drive shaft 110 and meshed with the intermediate gear 118.

A paper feeding lever drive transmission system 120 of the drive mechanism 11 is composed of a cam 121 integrally formed with the cam gear 119, a cam driven arm 124 mounted rotatably about a pivot shaft 122 on the rear wall 87*b* and pressed against the cam 121 by a tension coiled spring 123, a slide link 125 slidingly movable in the horizontal direction to the rear wall 87*b* and slidingly driven by a loosened engagement portion of the cam driven arm 124, a drive side arm 127 mounted rotatably about a pivot shaft 126 at the slide link 125, and a driven side arm 129 which is mounted on the rotary shaft 92 of the paper feeding lever 99 and which is coupled with or separated from the drive side arm 127 as desired. The driven side arm 129 is subjected to a positional restriction by a torque limiter spring 97 in the form of a return coil spring around the rotary shaft 92. The loosened engagement portion of the cam driven arm 124 and the slide link 125 is composed of an oblong hole 130 and a pin 131. The slide link 125 is slidingly movable relative to the rear wall 87*b* through a pair of guides 132 and the oblong hole 133.

Figure 8:
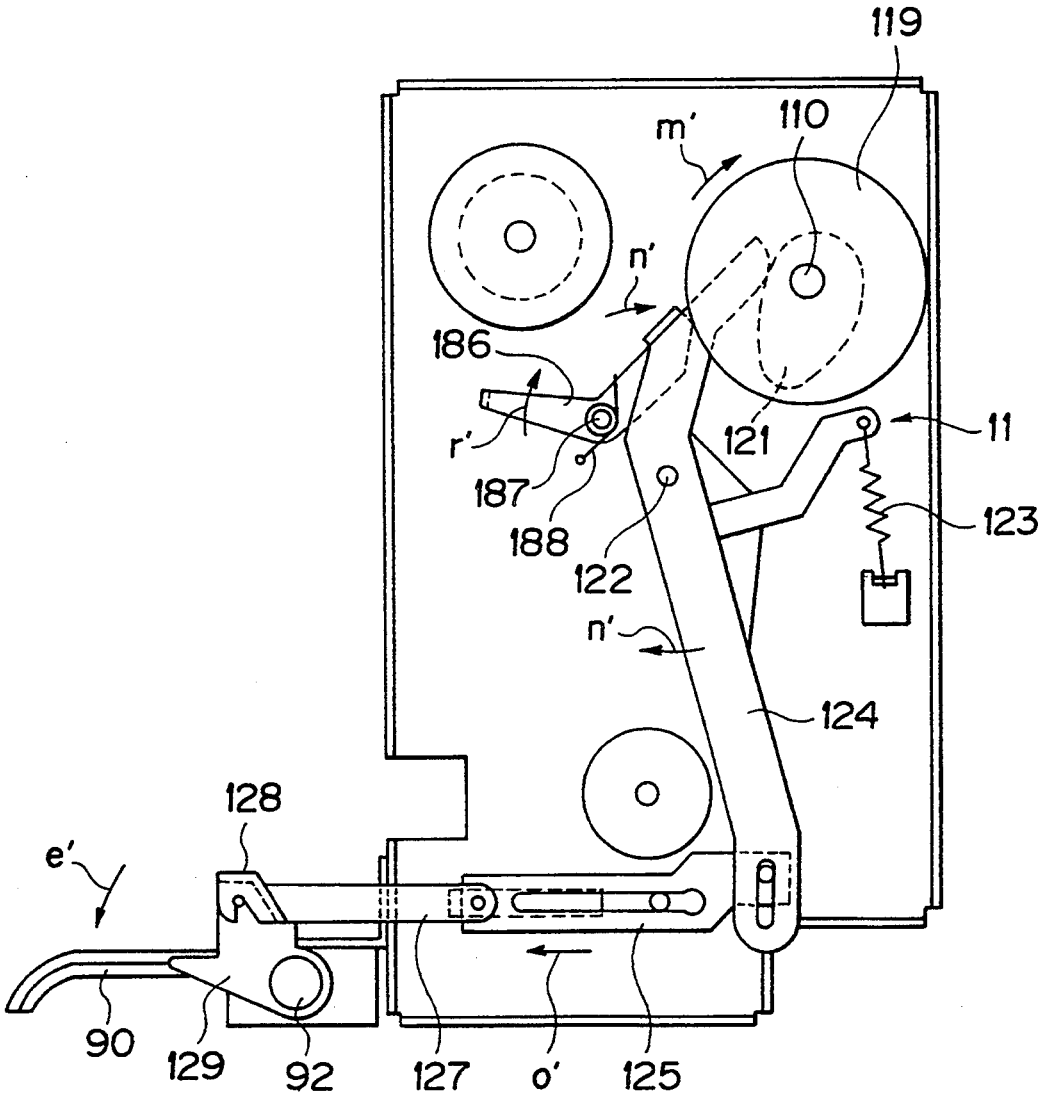
FIG. 8 is a side elevational view showing a home position of the thermal head/paper feeding lever drive mechanism.

With respect to the drive mechanism 11, FIG. 8 shows a home position corresponding to FIG. 12.

Figure 9:
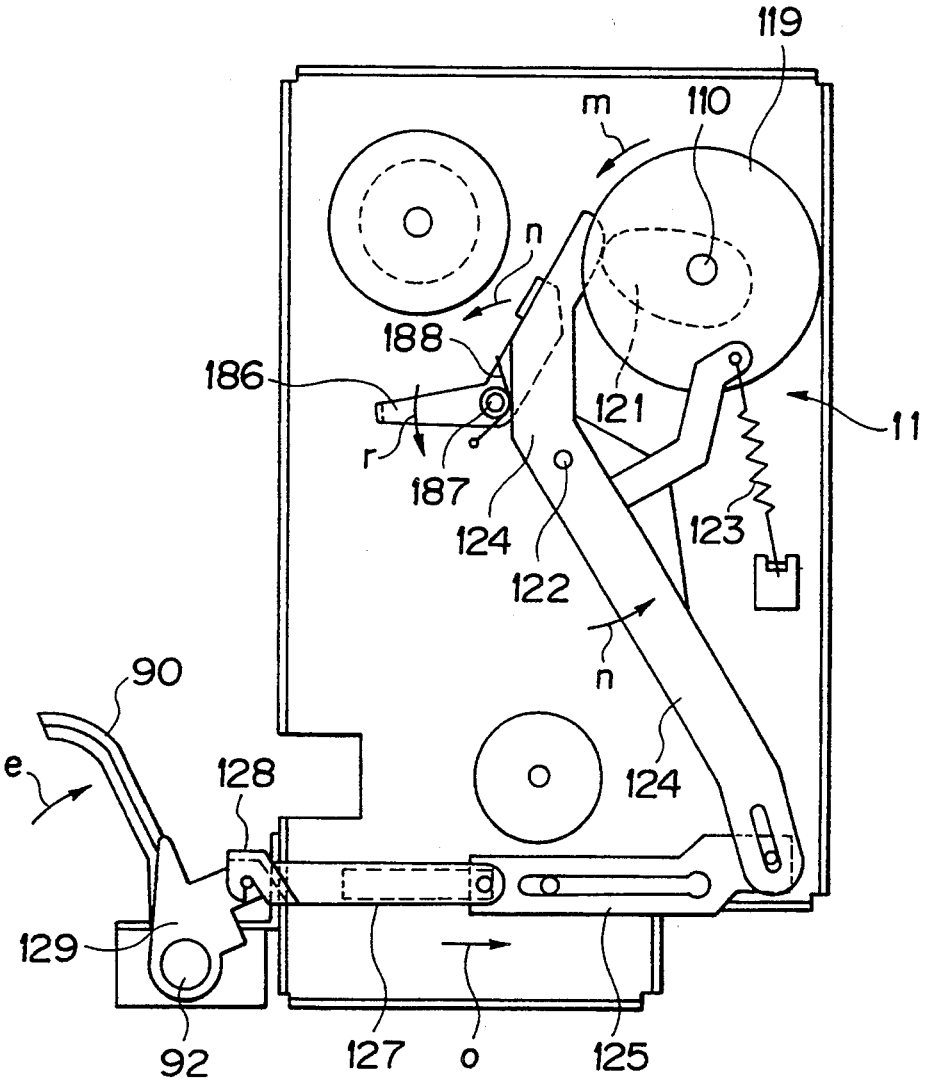
FIG. 9 is a side elevational view showing a paper feeding position of the thermal head/paper feeding lever drive mechanism.

FIG. 9 shows the paper feeding mode explained in conjunction with FIG. 13. The thermal head drive shaft 110 is drivingly rotated through a small angle in the direction of the arrow m through the thermal head drive transmission system 114 by means of the motor 115. As shown by the one-dot and dash line in FIG. 13, the thermal head 83 is drivingly rotated by the small angle in the direction of the arrow h about the pivot lever shaft 82 through the drive arm 112 and the link 111. In synchronism with this, the cam driven arm 124 is drivingly rotated in the direction of the arrow n about the pivot shaft 122 against the tension coiled spring 123 by the cam 121 of the paper feeding lever drive mechanism 120. The slide link 125 and the drive side arm 127 are slid in the direction of the arrow o, and the paper feeding lever 90 is drivingly rotated in the direction of the arrow e through the driven side arm 129 and the rotary shaft 92. Thereafter, as shown in FIG. 8, the reverse rotation of the motor 115 causes the thermal head drive shaft 110 to return in the direction of the arrow m', causes the thermal head 83 to return in the direction of the arrow h' as shown by the solid line in FIG. 13, and also causes the paper feeding lever 90 to return in the direction of the arrow e'.

Figure 10:
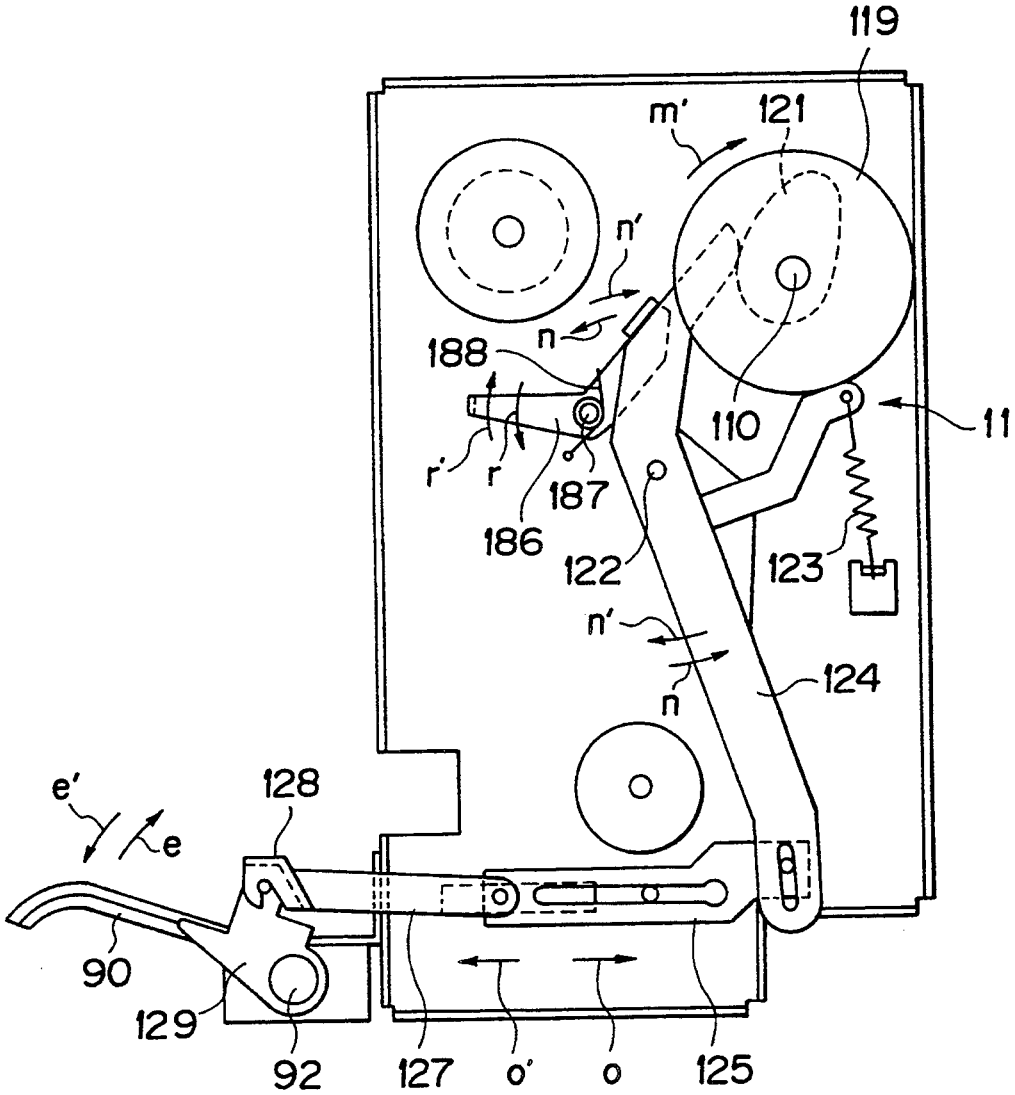
FIG. 10 is a side elevational view showing a printing position of the thermal head/paper feeding lever drive mechanism.

FIG. 10 shows the printing position corresponding to FIG. 14. The thermal head drive shaft 110 is rotated reversely through a large angle in the direction of the arrow m' by the motor 115 through the thermal head drive transmission system 114. As shown in FIG. 14, the thermal head 83 is drivingly rotated through a large angle in the direction of the arrow h about the pivot lever shaft 82 through the driving arm 112 and the link 111. The ink ribbon 84 is pressed against the sheet of paper 2 on the outer circumference of the planten 80 by the thermal head 83. At this time, the cam driven arm 124 is swung in the directions of the arrows n and n' about the pivot shaft 122 by the cam 121 of the paper feeding lever driving mechanism, and the slide link 125 and the driving side arm 127 are reciprocatingly moved in the directions of the arrows o and o'. Then, the paper feeding lever 90 is reciprocatingly moved in the directions of the arrows e and e' and is stopped at the position shown in FIG. 10.

Figure 6:
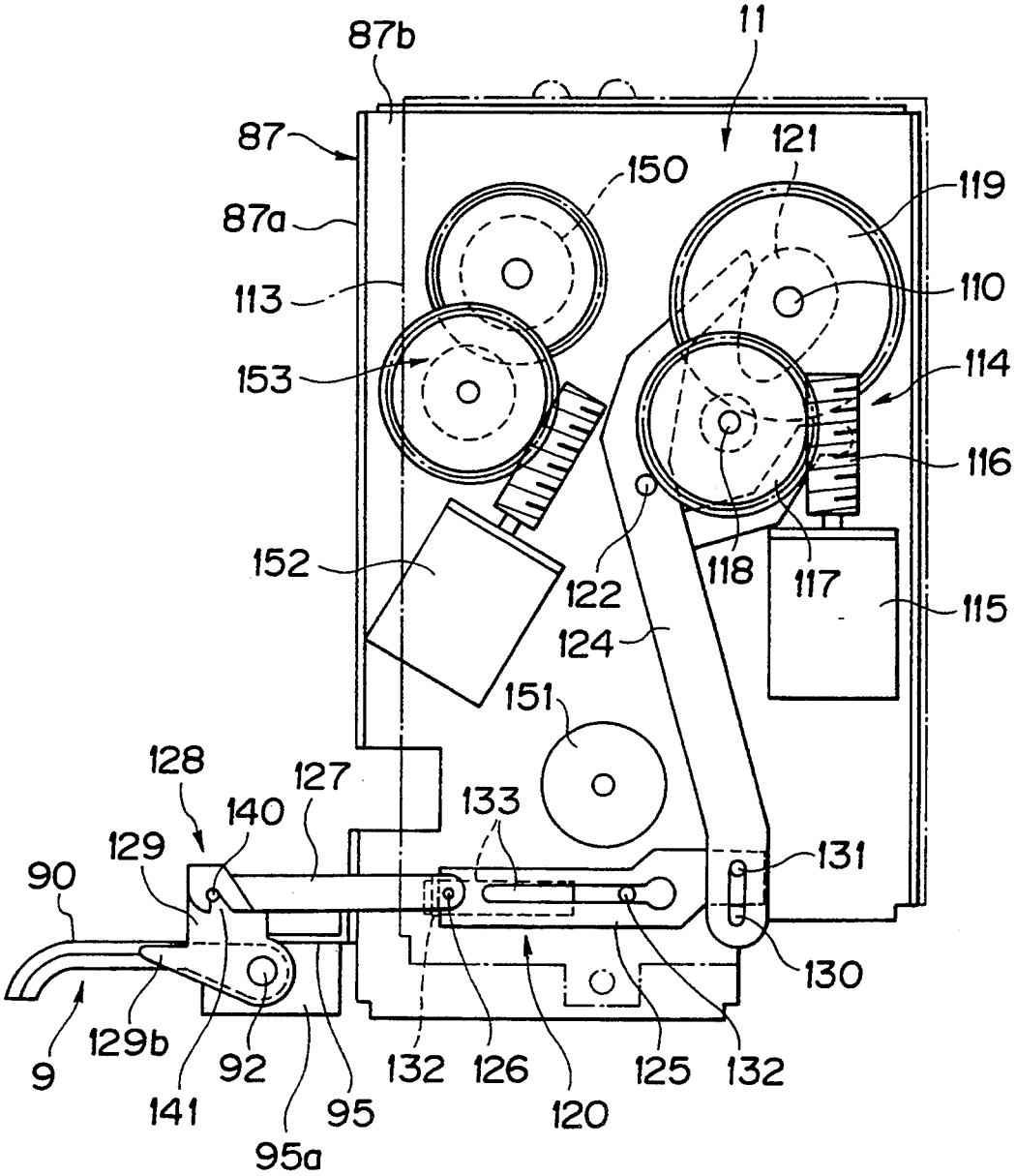
FIG. 6 is a side elevational view showing a thermal head/paper feeding lever drive mechanism.
Figure 7:
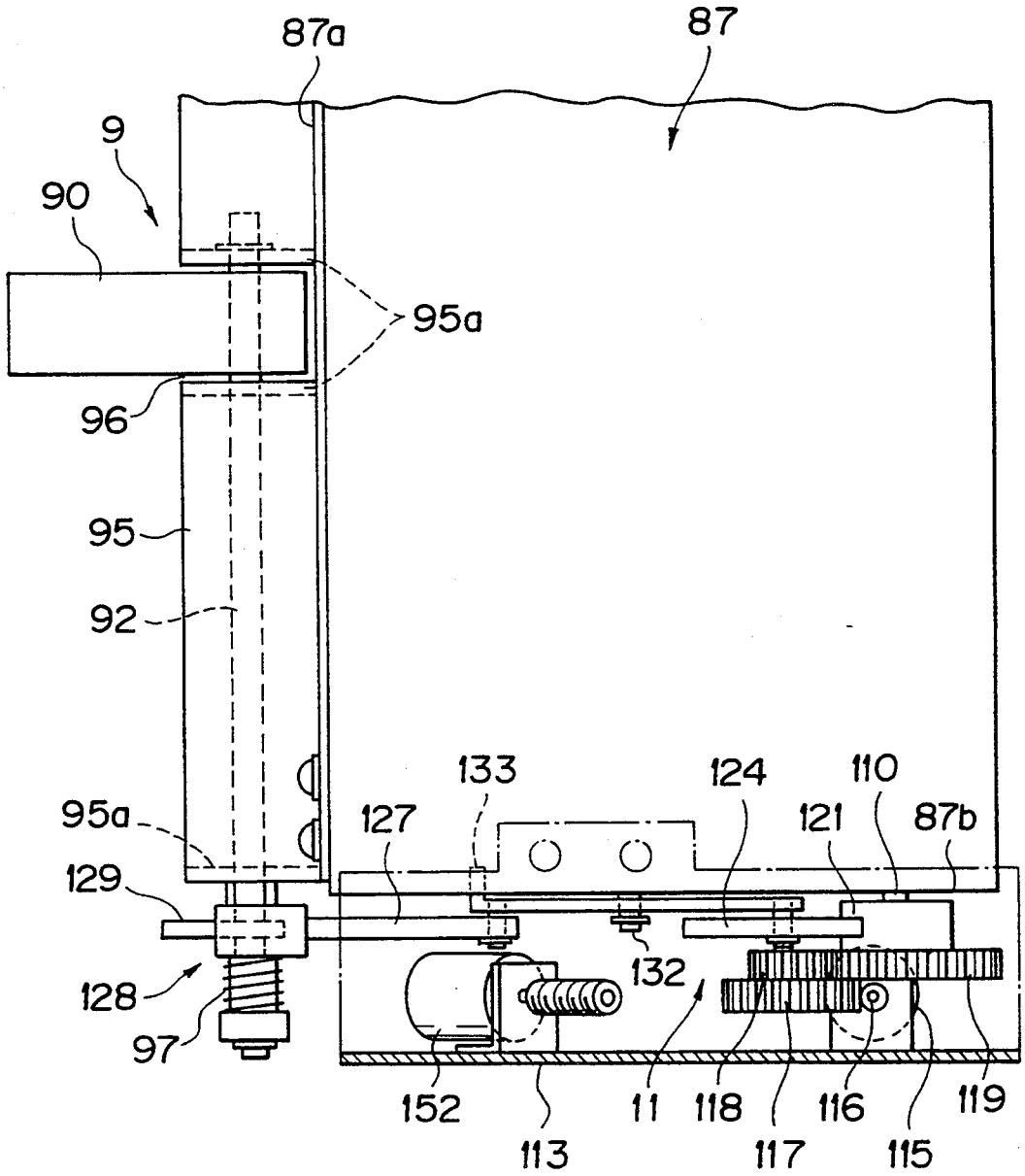
FIG. 7 is a partially fragmentary plan view of FIG. 6.

As shown in FIGS. 6 and 7, disposed between the rear wall 87*b* of the printing device block 87 and the bracket 113 are a winding reel shaft 150 and a supply reel shaft 151 on which the winding reel 85 and the supply reel 86 are mounted and a winding reel shaft drive mechanism for drivingly rotating the winding reel shaft 150 through a gear train 153 and a torque limiter (not shown) by the motor 152.

Explanation of Platen and Paper-ejecting Roller Drive Mechanism

Figure 4:
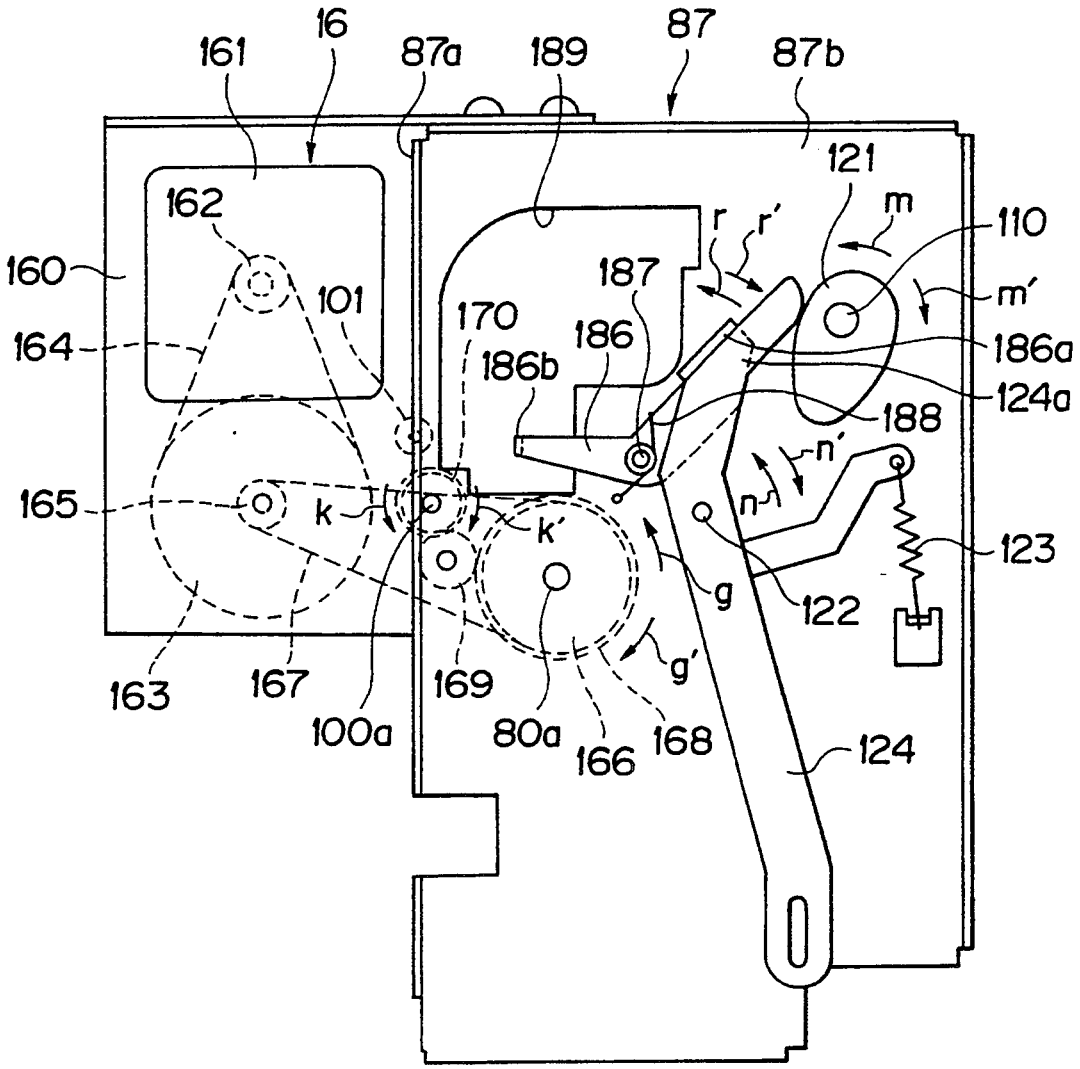
FIG. 4 is a side elevational view showing a platen/paper-ejecting roller drive mechanism.
Figure 5:
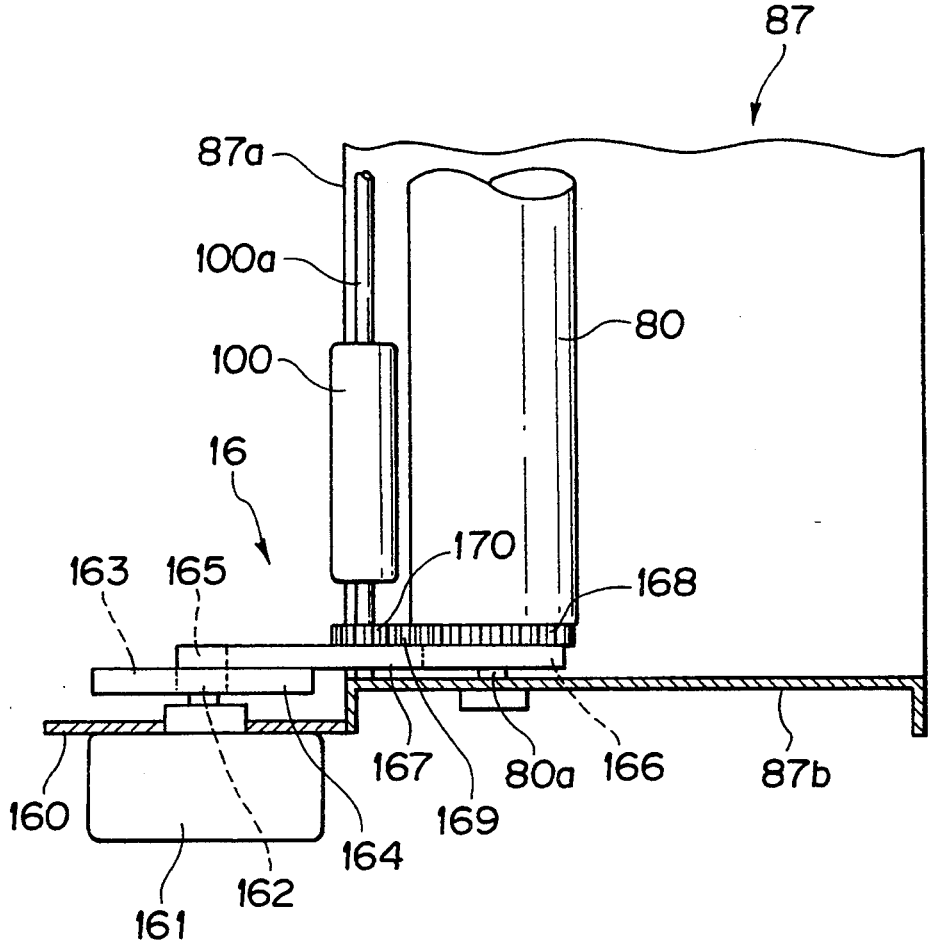
FIG. 5 is a partially fragmentary plan view of FIG. 4.

A platen/paper-ejecting roller drive mechanism (which will be hereinafter referred to as a "drive mechanism") will be explained with reference to FIGS. 4 and 5.

Roller shafts 80*a* and 100*a* for the platen 80 and the paper-ejecting rollers 100 are horizontally provided in the printing block 87. In the drive mechanism 16, a motor 161 is mounted on a bracket 160 fastened to the side wall 87*a* of the printing block 87 on the rear wall 87*b* side by fastening means such as rivets, a timing belt 164 is wound about a timing pulley 162 fixed to the motor shaft and a timing pulley 163 mounted on the bracket 160, and a timing belt 167 is wound between a timing pulley 166 formed integrally with the timing pulley 163 and a timing pulley 166 formed integrally with an end portion of the platen 80. A gear 168 formed integrally with the end portion of the platen 80 is meshed with a gear 170 fixed to the end portion of the roller shaft 100*a* of the paper-ejecting rollers 100 through an intermediate gear 169 mounted on an inside of the rear wall 87*b*.

By the forward/reverse drive rotation of the motor 161, the platen 80 is drivingly rotated in the forward-/reverse directions indicated by the arrows g and g' through the timing belts 164 and 167. The drive force of the platen 80 is transmitted to the paper-ejecting rollers 100 through the gears 168, 169 and 170. The paper-ejecting rollers 100 are rotated in the forward/reverse direction indicated by the arrows k and k' in synchronism with the platen 80.

Explanation of Pressing Mechanism for Paper-ejecting Device

A pressing mechanism 18 for pressing the pressing rollers 101 against the paper-ejecting rollers 100 and separating the pressing rollers 101 away from the paper-ejecting rollers 100 in the paper-ejecting device 10 will now be described with reference to FIGS. 1 to 4.

A pair of support levers 181 are supported rotatably in the direction (vertical direction) of the arrows q and q' to a pair of mounting pieces 180*a*, formed integrally with both front and rear ends of a mounting plate 180, through a pair of pivot shafts 182 which are horizontally provided in a common axis. The pressing rollers 101 are horizontally provided rotatably on the roller shaft 101*a* between end portions of the pair of support levers 181.

A pressing lever 183 having a substantially U shape in plan view is supported rotatably in the direction of the arrows q and q' about a pair of pivot shafts 182 by a pair of front and rear side walls 183*a*.

A leaf spring 184 which is a press-fit spring having a substantially U shape in plan view and a substantially L shape in cross section is mounted on and overlapped with the top and side surfaces of the pressing lever 183. A vertical side piece 184*a* of the leaf spring 184 is fastened by fastening means such as rivets to a side surface of a vertical plate 183*b* connecting a pair of side plates 183*a* of the pressing lever 183. A pair of pressing pieces 184*a* at both front and rear ends of the leaf spring 184 are pressed from above against a pair of projections 181*a* formed integrally with top surfaces of the pair of support levers 181. The pair of support levers 181 are brought into contact with horizontal support pieces 183*c* formed integrally with lower ends of the pair of side plates 183*a*.

By a pair of front and rear brackets 180*b* contiguous with a pair of side plates 180*a* of the mounting plate 180, the mounting plate 180 is horizontally fastened at a position above the opening 88 of the side wall 87*a* of the printing device block 87 with rivets or the like. The pressing rollers 101 are horizontally provided in parallel with and above the paper-ejecting rollers 100.

A synchronous lever 186 is mounted rotatably in the direction of the arrows r and r' about a pivot shaft 187, outside the rear wall 87*b* of the printing device block 87 and in the vicinity of the end 124*a* of the cam driven arm 124 of the above-described thermal head/paper feeding lever driving mechanism 11. The synchronous lever 186 is rotatably biased in the direction of the arrow r' by a return coil spring 188, and is always in contact with the end 124*a* of the cam driven arm 124 by a contact piece 186*a* formed at one end of the synchronous lever 186.

A drive piece 186*b* which is integrally formed at the other end of the synchronous lever 186 and is bent substantially in an L shape horizontally penetrates an opening 189 formed in the rear wall 87*b*. A driven piece 183*d* formed integrally with one end of the pressing lever 183 extends toward the drive piece 186*b* and the end of the drive piece 186 is loosely engaged with a slit 190 formed in the driven piece 183*d*.

Operation of Pressing Mechanism

The thus constructed pressing mechanism 18 will be explained.

As shown in FIGS. 9 and 10, when the cam 121 of the drive mechanism 11 is drivingly rotated in the forward-/reverse direction of the arrows m and m' and the cam driven arm 124 is drivingly rotated in the forward-/reverse direction of the arrows n and n' about the pivot shaft 124 in cooperation with the tension coiled spring 123, the synchronous lever 186 is drivingly rotated in the forward/reverse direction of the arrows r and r' about the pivot shaft 187 in cooperation with the cam driven arm 124.

Figure 1:
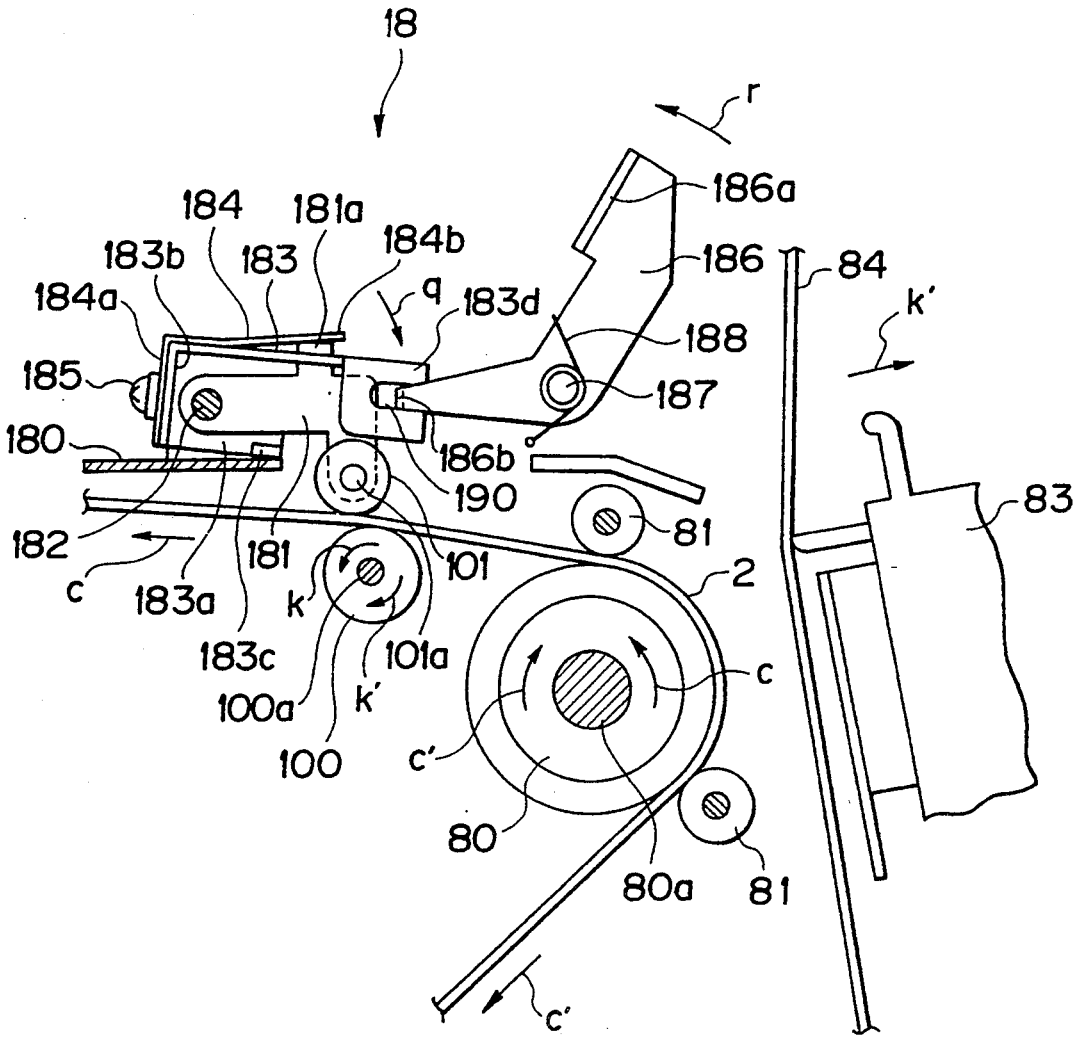
FIG. 1 is a cross-sectional, side elevational view showing a primary part of a pressing mechanism of a video printer in the pressing position in accordance with one embodiment of the invention.

As shown in FIG. 1, when the synchronous lever 186 is drivingly rotated in the direction of the arrow r, the drive piece 186*b* drives the driven piece 183*d*, so that the pressing lever 183 and the leaf spring 184 are rotatably driven together in the direction of the arrow q about the pair of pivot shafts 182. The pressing rollers 101 are pressed against the paper-ejecting rollers 100 in the direction of the arrow q.

In this case, since the pressing lever 183 is drivingly rotated in the direction of the arrow q by the overstroke and the pair of pressing pieces 184 of the leaf spring 184 push the pair of projections 181*a* of the pair of the support lever 181 in the direction of the arrow q, the pressing rollers 101 are pressed against the paper-ejecting rollers 100 against the spring force of the pair of pressing pieces 184.

Figure 2:
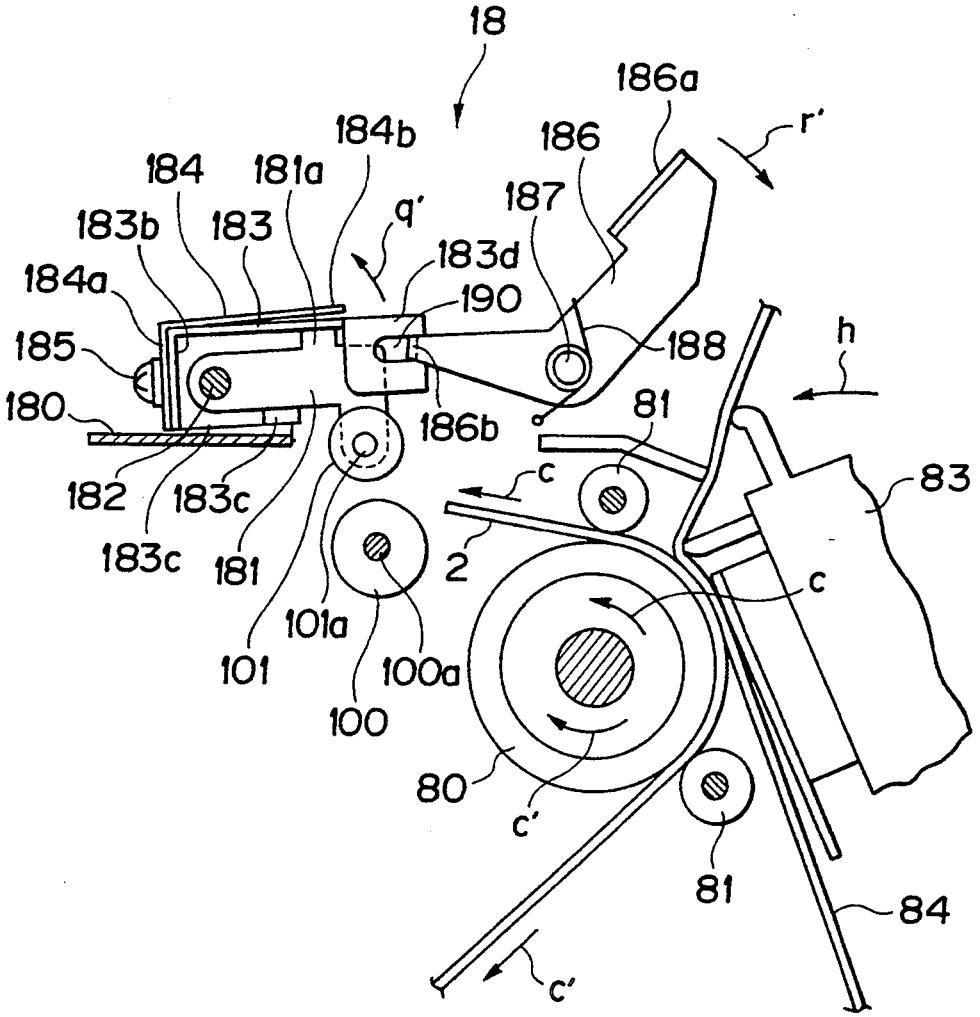
FIG. 2 is a cross-sectional, side elevational view showing the primary part of the pressing mechanism under a separated state.

Subsequently, as shown in FIG. 2, when the sychronous lever 186 is drivingly rotated in the direction of the arrow r', the drive piece 186*b* drives the driven piece 183*d*, and the pressing levers 183 and the leaf spring 184 are drivingly rotated together in the direction of the arrow q' about the pair of pivot shafts 182. The pair of support levers 181 are drivingly rotated in the direction of the arrow q' about the pair of support shafts 182 by the pair of support pieces 183c of the pressing levers 183. The pressing rollers 101 are separated away from the paper-ejecting rollers 100 upwardly in the direction of the arrow q'.

Therefore, the pressing mechanism 18 is driven in synchronism with the pressing and separating operation of the thermal head 83 relative to the platen 80 by the drive mechanism 11.

More specifically, in the initial state shown in FIG. 12, the pressing rollers 101 are separated away from the paper-ejecting rollers 100 in the direction of the arrow q' as shown in FIG. 2.

In the paper feeding mode shown in FIG. 13, the pressing rollers 101 are pressed against the paper-ejecting rollers 100 in the direction of the arrow q as shown in FIG. 1. Accordingly, in the paper feeding mode, the sheet of paper 2 which is transported while being pressed against the outer circumference of the platen 80 by the pair of the pinch rollers 81 is also delivered while being pressed against the paper-ejecting rollers 100 by the pressing rollers 101. Thus, the sheet of paper 2 may be delivered at a high speed in the directions of the arrows c and c' by the duplication of the drive force of the platen 80 in the directions of the arrows c and c' and the drive force of the paper-ejecting rollers 100 in the directions of the arrows k and k'.

In the printing mode shown in FIG. 14, the pressing rollers 101 are separated away from the paper-ejecting rollers 100 in the direction of the arrow q'. Accordingly, in the printing mode, the sheet of paper 2 may be transported at a low speed in the directions of the arrows c and c' only by the drive force of the platen 80. Accordingly, there is no fear that the sheet of paper 2 would accidentally slip on the platen 80. Also, there is no damage of the printed images immediately after the printing. There is also no image offset at all. Since the leading edge of the sheet of paper 2 is never collided between the paper-ejecting rollers 100 and the pressing rollers 101 immediately after the printing. Therefore, there is no fear that uneven printing (stripe contaminant) would occur due to the collision of the leading edge with the rollers. Accordingly, it is possible to obtain a clear printed image with high precision.

In the paper-ejecting mode shown in FIG. 15, as shown in FIG. 1, the pressing rollers 101 are pressed against the sheet of paper 2 on the paper-ejecting rollers 100 in the direction of the arrow q. The sheet 2 may be ejected at a high speed in the direction of the arrow c from the outer circumference of the platen 80 by the driving force of the paper-ejecting rollers 100 in the direction of the arrow k.

Figure 3:
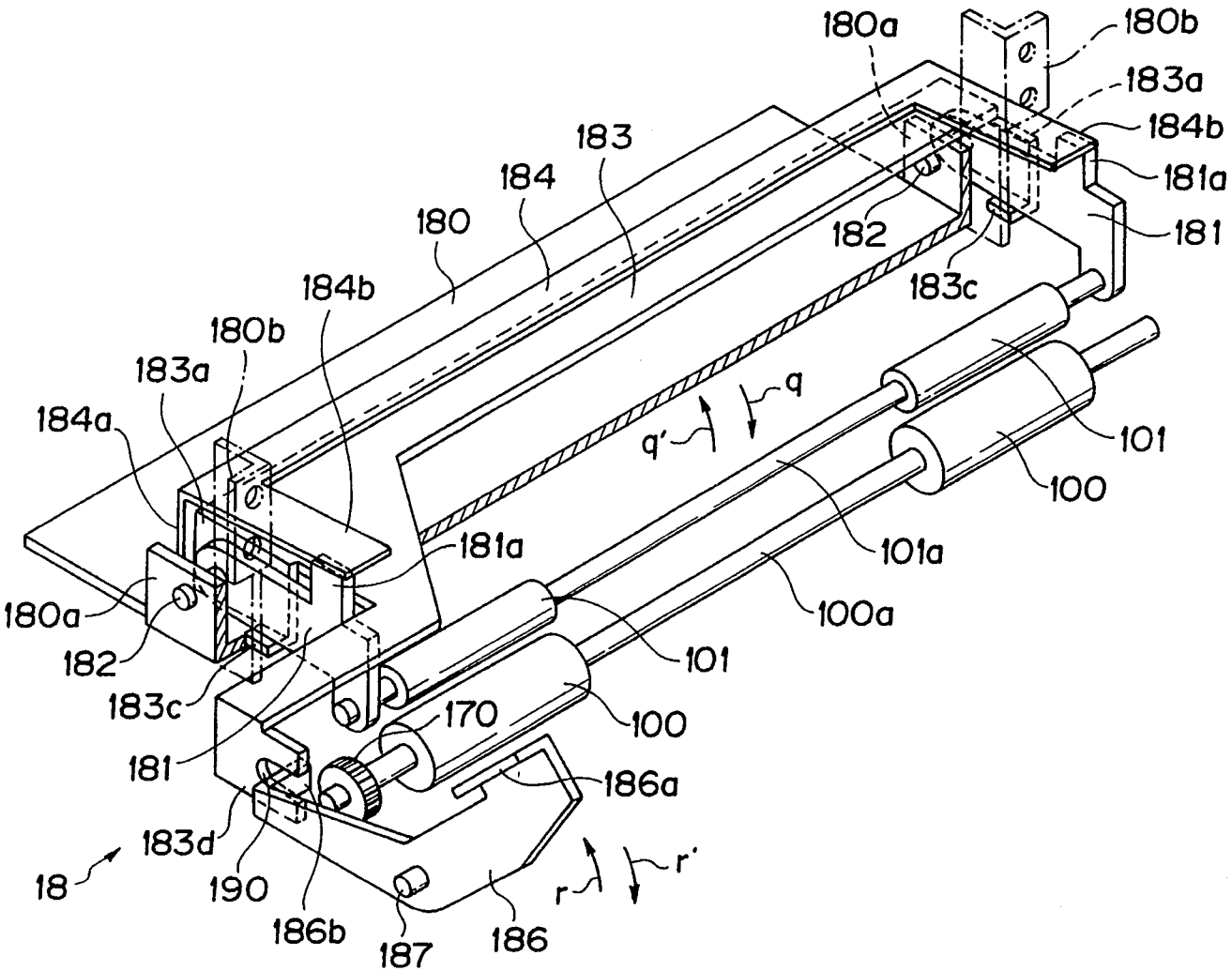
FIG. 3 is a partially fragmentary perspective view showing the pressing mechanism.

As shown in FIGS. 1 to 3, the structure of the pressing mechanism 18 in which the pair of support levers 181 and the pressing levers 183 are rotatably mounted on the pair of common support shafts 182 and the leaf spring 184 which is the pressing spring is fastened to the pressing levers 183 by rivets or the like may be made simple and compact to save the mounting space.

Although the specific embodiment of the invention has been described, it is apparent that the present invention is not limited thereto and it is possible for those skilled artisan to modify and change the embodiment within a scope of the invention.

For example, in the embodiment shown, the pressing rollers 101 are arranged above the paper feeding rollers 100 but it is of course possible to reverse the vertical positional relationship between the rollers.

Also, it is possible to modify the arrangement so that the pressing rollers 101 are separated apart from the paper-ejecting rollers 100 in the transportation of the sheet of paper 2 in the directions of the arrows c and c' in the paper feeding mode and/or in the transportation of the sheet of paper 2 in the direction of the arrow c' in the printing mode.

The thus constructed video printer according to the present invention has the following advantages.

By the arrangement in which the pressing rollers are pressed against and separated away from the paper-ejecting rollers by the pressing mechanism of the paper-ejecting device, the pressing rollers are separated apart from the paper-ejecting rollers at least in the printing mode, the pressing rollers are pressed against the paper-ejecting rollers at least in the paper-ejecting mode to thereby eject the sheet of printed paper outside the printing device, and the sheet of paper is transported only by the driving force of the platen, the double driving force by the platen and the paper feeding roller is not applied to the sheet of paper in the printing mode. It is therefore possible to avoid the damage of the printed surface and the offset of the printed images just after the printing due to the slippage of the sheet of paper relative to the platen during the printing operation. At the same time, it is possible to avoid the uneven print due to the collision of the leading edge of the sheet of paper between the paper ejecting rollers and the pressing rollers just after the printing operation, and to provide a clear image with high precision.

In this case, if the pressing rollers are pressed against and separated away from the paper-ejecting rollers in synchronism with the operation of the pressing and separation of the thermal head relative to the thermal head, the pressing mechanism may be made simple by the thermal head drive mechanism. The structure and control may be simplified.

If the support levers for pressing the pressing rollers against the paper-ejecting rollers and separating the pressing rollers away from the paper-ejecting rollers are drivingly rotated through the pressing spring by the pressing levers, the support levers and the pressing levers are rotatably supported to the common support shafts, and the pressing spring is made of a leaf spring, it is possible to make the pressing mechanism simple in structure and compact in size. Thus, it is possible to save the mounting space of the pressing mechanism in the video printer. Therefore, the video printer may be made small in size.

What is claimed is:

1. A printer for printing an image on a sheet of paper, comprising:

a printing device having a thermal head, a platen and an ink ribbon;

a head moving means for moving said thermal head between a printing position and a paper-ejecting position;

a paper feeding device for intermittently supplying to the printing device sheets of paper from a paper stack in a paper feeding tray;

a lever means for selectively moving said paper stack into engagement with said paper feeding device;

a paper-ejecting device comprising a paper-ejecting roller and a pressing roller for ejecting the sheet of paper from the printing device; and a pressing means for selectively moving the pressing roller into and out of engagement with the paper-ejecting roller;

wherein said pressing means, lever means and head moving means are synchronized by a cam assembly such that in a first position of said cam assembly the lever means moves said paper stack into engagement with said paper feeding device, said pressing means moves said pressing roller into engagement with the paper-ejecting roller and said head moving means moves said head into said paper-ejecting position, and in a second position of said cam assembly said lever means moves said paper stack away from said paper feeding device, said pressing means moves said pressing roller away from the paper-ejecting roller and said head moving means moves said head into said printing position.

2. The printer as set forth in claim 1, wherein said pressing means comprises a pivotally mounted synchronous lever and a pivotally mounted pressing lever, said synchronous lever having a first end for receiving a moving force from a cam of said cam assembly and a second end in engagement with said pressing lever.

3. The printer as set forth in claim 2, wherein said pressing means further comprises a support lever having a first end mounted for movement about an axis coaxial with a pivot axis of said pressing lever and a second end supporting said pressing roller.

4. The printer as set forth in claim 3, further comprising a pressing spring operatively connected between said support lever and said pressing lever for limiting relative pivotal movement between said support lever and said pressing lever such that said pressing spring biases said pressing roller into engagement with said paper-ejecting roller when said cam assembly is in said first position.

5. The printer as set forth in claim 4, wherein said pressing spring is a leaf spring having a first end engaging said support lever and a second end fixed to said pressing lever.

6. The printer as set forth in claim 4, wherein said lever means comprises a rotatably mounted cam driven arm having a first end in engagement with said cam and a second end operatively connected to a paper feeding lever for raising the stack of paper in said paper tray into engagement with said paper feeding device when said cam assembly is in said first position.

7. The printer as set forth in claim 6, wherein said first end of said synchronous lever is engaged with said cam driven arm between said first end of the cam driven arm and a pivot axis of said cam driven arm.

8. The printer as set forth in claim 7, further comprising a return coil spring biasing said synchronous lever into engagement with said cam driven arm.

9. The printer as set forth in claim 8, further comprising a tension spring biasing said cam driven arm into engagement with said cam.

10. The printer as set forth in claim 1, wherein said head moving means comprises a drive arm mounted for rotation with said cam assembly, and a link pivotally connecting said drive arm to said thermal head.

11. A printer for printing an image on a sheet of paper, comprising:

a printing device having a thermal head, a platen and an ink ribbon;

a head moving means for moving said thermal head between a printing position and a paper-ejecting position;

a paper feeding device for intermittently supplying to the printing device sheets of paper stacked and received in a paper feeding tray;

a paper-ejecting device for pressing the sheet of paper against a paper-ejecting roller by at least one pressing roller and for ejecting the sheet of paper from the printing device;

a pressing mechanism for moving the pressing roller into and out of engagement with the paper-ejecting roller; and a control means for synchronizing the movement of said pressing mechanism and said thermal head such that the pressing mechanism separates the pressing roller away from the paper-ejecting roller when said thermal head is in said printing position and presses the pressing roller against the paper-ejecting roller when said thermal head is in said paper-ejecting position, said control means comprising a rotatable shaft having a cam and a drive arm mounted thereto, said cam operatively engaging said pressing mechanism, and said drive arm being rotatably connected to said thermal head.

12. The printer as set forth in claim 11, wherein said pressing mechanism comprises a pivotally mounted synchronous lever and a pivotally mounted pressing lever, said synchronous lever having a first end for receiving a moving force from said cam and a second end in engagement with said pressing lever.

13. The printer as set forth in claim 12, wherein said pressing mechanism further comprises a support lever having a first end mounted for movement about an axis coaxial with a pivot axis of said pressing lever and a second end supporting said pressing roller.

14. The printer as set forth in claim 13, further comprising a leaf spring operatively connected between said support lever and said pressing lever for limiting relative pivotal movement between said support lever and said pressing lever such that said leaf spring biases said pressing roller into engagement with said paper-ejecting ejecting roller when said head is in said paper-ejecting position.

* * * * *